US010683683B2

(12) United States Patent
Hunt

(10) Patent No.: US 10,683,683 B2
(45) Date of Patent: Jun. 16, 2020

(54) LATCH WITH CLOSURE DEVICE FOR A MOTOR VEHICLE

(71) Applicant: Kiekert AG, Heiligenhaus (DE)

(72) Inventor: Robert J. Hunt, Davisburg, MI (US)

(73) Assignee: Kiekert AG, Heiligenhaus (DE)

( * ) Notice: Subject to any disclaimer, the term of this patent is extended or adjusted under 35 U.S.C. 154(b) by 451 days.

(21) Appl. No.: 15/496,504

(22) Filed: Apr. 25, 2017

(65) Prior Publication Data

US 2018/0305957 A1 Oct. 25, 2018

(51) Int. Cl.
*E05B 81/40* (2014.01)
*E05B 81/20* (2014.01)
(Continued)

(52) U.S. Cl.
CPC ..... *E05B 81/40* (2013.01); *E05B 81/06* (2013.01); *E05B 81/16* (2013.01); *E05B 81/20* (2013.01); *E05B 81/74* (2013.01); *E05B 81/14* (2013.01); *E05B 81/64* (2013.01); *E05B 81/66* (2013.01); *E05B 81/68* (2013.01); *E05B 81/72* (2013.01); *Y10T 292/108* (2015.04);
(Continued)

(58) Field of Classification Search
CPC ..... E05B 81/40; E05B 81/06; E05B 81/16; E05B 81/20; E05B 81/74; E05B 81/64; E05B 81/14; E05B 81/66; E05B 81/68; E05B 81/72; Y10T 292/108; Y10T 292/1082; Y10T 292/1092; Y10T 292/1047; Y10T 292/1043
See application file for complete search history.

(56) References Cited

U.S. PATENT DOCUMENTS 4,135,377 A 1/1979 Kleefeldt et al.
5,137,312 A 8/1992 Tang et al.
(Continued)

FOREIGN PATENT DOCUMENTS

DE 2911681 10/1980
DE 198 12 606 A1 9/1999
(Continued)

OTHER PUBLICATIONS

International Search Report and Written Opinion of PCT/IB2018/000226 dated Jun. 29, 2018.

*Primary Examiner* — Kristina R Fulton
*Assistant Examiner* — Faria F Ahmad
(74) *Attorney, Agent, or Firm* — Renner, Otto, Boisselle & Sklar, LLP

(57) ABSTRACT

The object of the invention is a motor vehicle latch (1), in particular an electrically actuated flap latch, demonstrating a locking mechanism (11) comprising a catch (10) and at least one pawl, a triggering lever (9), whereby by means of the triggering lever (9) the locking mechanism (11) can be unlocked, a closure device (8), whereby by means of the closure device (8) the locking mechanism (11) can be transferred at least from a pre-ratchet position into a main ratchet position and the closure device (8) demonstrates a spindle drive (4), whereby a functional position (N, O, Z) of the spindle drive (4) can be recorded by sensors, and whereby the spindle drive (4) demonstrates a spindle nut (5) and the spindle nut (5) interacts with an activation device (6) in such a way that using a sensor (7) at least a functional position (N, O, Z) of the spindle nut (5) can be detected.

19 Claims, 2 Drawing Sheets

Figure 1:
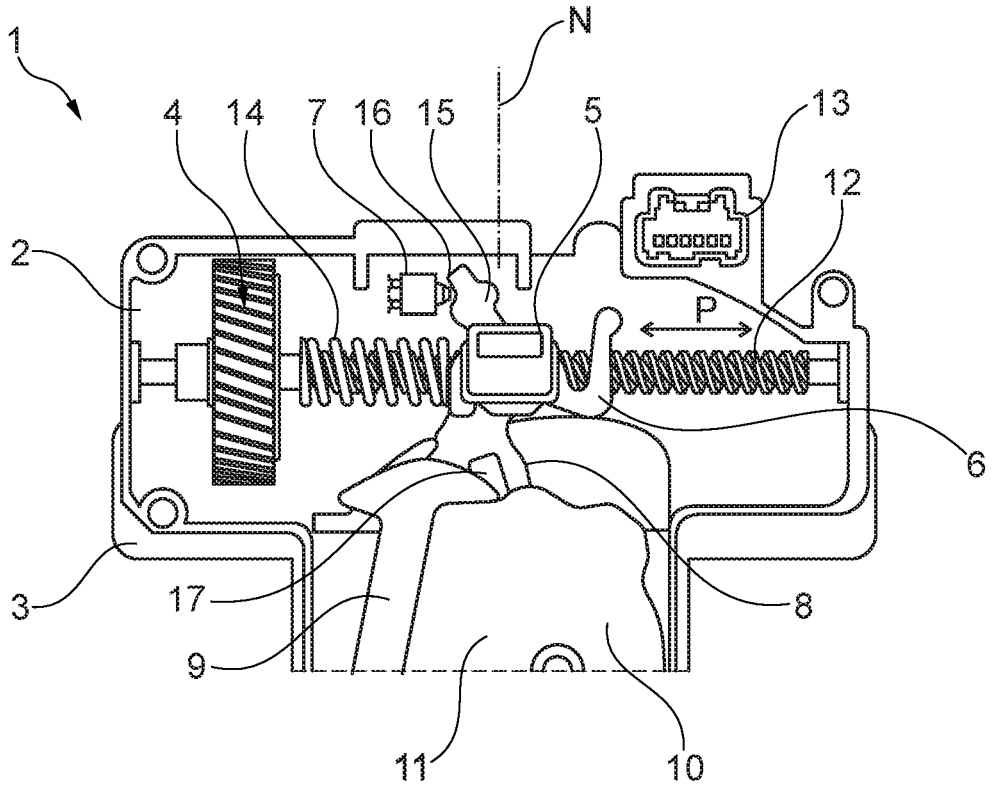

(51) Int. Cl.

| | |
|---|---|
| ***E05B 81/16*** | (2014.01) |
| ***E05B 81/74*** | (2014.01) |
| ***E05B 81/06*** | (2014.01) |
| ***E05B 81/72*** | (2014.01) |
| ***E05B 81/66*** | (2014.01) |
| ***E05B 81/68*** | (2014.01) |
| ***E05B 81/64*** | (2014.01) |
| ***E05B 81/14*** | (2014.01) |

(52) U.S. Cl.
CPC .... *Y10T 292/1043* (2015.04); *Y10T 292/1047* (2015.04); *Y10T 292/1082* (2015.04); *Y10T 292/1092* (2015.04)

(56) References Cited

U.S. PATENT DOCUMENTS

| | | | | |
|---|---|---|---|---|
| 6,568,720 | B1 | 5/2003 | Szablewski | |
| 6,997,488 | B2 * | 2/2006 | Kurten | E05B 81/14 292/201 |
| 9,725,931 | B2 * | 8/2017 | Topfer | F16C 1/145 |
| 2011/0012380 | A1 * | 1/2011 | Bendel | E05B 81/20 292/341.16 |
| 2016/0053517 | A1 * | 2/2016 | Tomaszewski | E05B 77/26 200/573 |
| 2016/0245000 | A1 * | 8/2016 | Ottino | E05B 81/18 |
| 2018/0016822 | A1 * | 1/2018 | Sturm | E05B 79/20 |
| 2018/0347240 | A1 * | 12/2018 | Jeong | E05B 79/20 |
| 2018/0355644 | A1 * | 12/2018 | Jeong | E05B 83/18 |
| 2019/0078361 | A1 * | 3/2019 | Worden | E05B 81/20 |

FOREIGN PATENT DOCUMENTS

| | | | | |
|---|---|---|---|---|
| DE | 102013112540 | | 6/2015 | |
| DE | 102017108752 | A1 * | 10/2018 | E05B 81/14 |
| EP | 1217156 | | 6/2002 | |
| EP | 1 319 780 | B1 | 6/2003 | |
| EP | 2653356 | | 10/2013 | |
| GB | 2207698 | | 2/1989 | |
| WO | WO 2009143799 | | 12/2009 | |

* cited by examiner

LATCH WITH CLOSURE DEVICE FOR A MOTOR VEHICLE

The invention relates to a motor vehicle latch, in particular an electrically actuated motor vehicle latch, demonstrating a locking mechanism comprising a catch and at least one pawl, a triggering lever, whereby by means of the triggering lever the locking mechanism can be unlocked, a closure device, whereby using the closure device the locking mechanism can be transferred at least from a pre-ratchet position into a main ratchet position and the closure device demonstrates a spindle drive, whereby a functional position of the spindle drive can be recorded by sensors.

In order to increase comfort in a motor vehicle and enable easiest possible operation of a motor vehicle, more and more comfort functions are integrated into the motor vehicle. It is thus known, for example, that motor vehicle doors, flaps or hoods are closed using a closure device. On the one hand, this can be justified by enabling light closure of the door, on the other hand this can be justified by for example, an external door handle being dispensed with in order to attain a relevant design or to simplify operation by the door being able to be closed automatically. In particular, such closure devices are in use in many cases on fully automated tailgates. For example, these flaps can be activated without manual activation of the flap itself, for example only with remote operation.

From EP 1 319 780 B1a motorized closure device is known which demonstrates a mechanically adjustable coupling carrier. A coupling lever with a coupling nose is adjustably arranged on the coupling carrier. The coupling nose is stressed on the catch by a spring element in the direction of a coupling catch and adjusted away from the coupling catch via a detachment device. The engagement of the coupling nose of the coupling lever into the coupling ratchet of the catch is thereby recorded by a sensor. The coupling nose then pivots the catch around its axis. Consequently, the catch closes in interaction with a latch holder.

A motor vehicle door latch with a locking bolt and a locking mechanism interacting with the locking bolt is known from DE 10 2016 124 781.2. The locking mechanism can thus be transferred from a pre-ratchet to a main ratchet position using a closure device. The closure device encompasses a spindle drive, whereby a spindle nut interacts with a lever gear to accomplish the closure movement. The closure levers which interact with the spindle nut demonstrate such kinematics that the necessary high closure forces are available on the catch. The spindle nut is driven on a spindle using an electrical drive, whereby the spindle drive is assigned a further function. In addition to the closure function, the locking mechanism can be unlocked by means of the spindle nut and in particular by means of an opposite movement. It is thus possible to provide different functions in the latch by means of the spindle nut or the spindle drive.

In a first end position of the spindle drive, the spindle nut interacts with a triggering lever which in turn can be engaged with the pawl of the locking mechanism. Consequently, unlocking of the locking mechanism can be enabled. In an end position of the spindle opposite the first end position the spindle nut interacts with the closure levers. Consequently, the locking mechanism and, in particular, the catch can be transferred into a main ratchet position. In the closed state of the locking mechanism, i.e. in the main ratchet position, the spindle nut is in a neutral central position, i.e. at a distance from the two end positions. Consequently, starting from this central position unlocking of the locking mechanism can be enabled. The functional position of the locking mechanism can be recorded by sensors, for example.

A recording of a functional position of a locking mechanism by sensors is known from DE 198 12 606 A1, for example. The functional positions of the locking mechanism can be recorded using two sensors, in particular microswitches. Thus, a microswitch interacts directly with the catch and a further microswitch with a storage lever. According to the activation position of the microswitch the functional position of the locking mechanism can be recorded.

In particular for a closure device of a locking mechanism with a spindle drive it is significant that the central position of the spindle nut of the spindle drive can be safely recorded. Because the central position, i.e. the position of the spindle nut at a distance from the two end positions enables quick activation of the triggering lever, for example. Safe recording of the central position or, in other words, the neutral position of the spindle nut is connected to the construction of the locking mechanism, the closure device and the triggering lever. In particular, positions result hereby for the spindle nut which can make recording of the neutral position of the spindle nut difficult. Making difficult is understood to mean that, for example, costly lever technology needs to be used and/or the position of the switching device can be specified by the spindle nut. This is where the invention is used.

The invention is based on the technical problem of further developing such a motor vehicle latch in such a way that recording of the neutral position of the spindle nut can be enabled which is as safe and simple as possible, whereby a simple and cost-effective construction should be guaranteed.

The task is solved by the characteristics of the independent patent claim 1. Advantageous designs of the invention are specified in the sub-claims. It is pointed out that the execution examples described hereafter are not restrictive; instead, any variations are possible of the characteristics described in the description and the sub-claims.

According to patent claim 1, the task of the invention is solved by a motor vehicle latch, in particular an electrically actuated flap latch being provided, demonstrating a locking mechanism comprising a catch and at least one pawl, a triggering lever, whereby by means of the triggering lever the locking mechanism can be unlocked, a closure device, whereby using the closure device the locking mechanism can be transferred at least from a pre-ratchet position into a main ratchet position and the closure device demonstrates a spindle drive, whereby a functional position of the spindle drive can be recorded by sensors and whereby the spindle drive demonstrates a spindle nut and the spindle nut interacts with an activation device in such a way that using a sensor at least a functional position of the spindle nut can be detected. The construction of the motor vehicle latch according to the invention now creates the possibility of directly recording the position of the spindle nut of the spindle drive. There is thus the possibility of directly recording the position or the functional position of the spindle nut. An activation device interacting directly with the spindle nut hereby enables recording of the neutral position of the spindle nut, for example. Consequently, safe positioning of the spindle nut can be achieved with the simplest constructional means. The direct engagement of the activation device into the spindle nut enables the position of the spindle nut to be recorded directly, but therefore also very accurately.

Different latches can be used as a motor vehicle latch. The motor vehicle latch can be used as a compact constructional unit, for example in a lateral door, a sliding door or in the vicinity of flaps or lids or covers. The motor vehicle latches encompassed by the invention are used where electrical actuation, i.e. electrically-assisted closure, should be enabled. Such electrically actuated motor vehicle latches are also known as servo latches. A preferred area of application for motor vehicle latches actuated in particular by means of a spindle drive are latches for tailgates of a motor vehicle.

A locking mechanism in a motor vehicle demonstrates a catch and at least one pawl, whereby the catch can be held in a locked position using the pawl. Two-stage locking mechanisms with a pre-ratchet and a main ratchet are used, as are systems with one or two pawls.

A triggering lever acts on the locking mechanism, whereby the triggering lever, for example, disengages one or several pawls from the catch by means of a pivoting movement. The triggering lever is preferably pivotably accommodated in the motor vehicle latch and preferably in a housing and/or a latch case of the motor vehicle latch.

The closure device according to the invention demonstrates a spindle drive. An electrical drive with, for example, a transmission gearing is used, whereby a movement of one of the spindle nuts arranged on the spindle can be enabled using the electrical drive. The spindle nut is driven on the spindle in different positions. An end position of the spindle nut is determined by reaching an end of the spindle. Hereby, the spindle nut can be driven against a stop of the housing and/or the spindle drive, or the end position is also recorded by sensors. The central position or neutral position of the spindle nut must not necessarily be arranged in the center of the spindle, but dependent on the construction of the motor vehicle latch can also be located outside of the center of the adjustment path of the spindle nut.

In turn, the spindle nut can be engaged with an activation device, whereby the activation device interacts with a sensor. The spindle nut does not absolutely need to be able to be engaged with the activation device, but according to the invention an extension can be arranged on the spindle nut, for example, which can be engaged with the activation device. The spindle nut preferably demonstrates a closure contour and an opening contour which can be engaged with both the closure device and the triggering lever. According to the construction, this contour or contours can be formed in such a way that the contours can also be engaged with the activation device, at least in places.

In a preferred execution form of the invention, the activation device can be detachably connected or engaged with the spindle nut. The spindle nut can advantageously be detachably connected to the activation device. There is thus the possibility that the activation device can be of a small construction and only formed in such a way that the spindle nut can be engaged with the activation device in the neutral position. Only the neutral position needs to be recordable as the end positions of the spindle nut, for example, can also be recorded by a fixed stop and a current increase in the motor caused thereby.

Hereby, a simple activation device of the smallest possible construction is enabled which, in turn, has a positive effect on the required installation space of the motor vehicle latch. In particular, the activation device can thus be of a small construction. In the simplest case, the activation device can be formed, for example, from a linearly mobile slider which can only be engaged with the spindle nut in the neutral position of the spindle nut. The possibility is created of safely recording the neutral position and at the same time there is the possibility of positioning the sensor or a microswitch in such a way that an electrotechnically favorable arrangement of the switching device is enabled in the motor vehicle latch. In particular, if the switching device can be arranged in proximity to the electrical contact of the motor vehicle latch, a favorable construction can be enabled for the electrical supplies or the electronic component carrier. Detachable hereby means that the spindle nut does not necessarily engage with the activation device in the respective functional positions. In particular, the spindle nut can be disengaged with the activation device in the end positions.

If the activation device can be pivotably accommodated in the housing, a further design variant of the invention results. A pivotable arrangement of the activation device enables a favorable interplay and in particular in the case of a detachable connection between the activation device and the spindle nut a safe engagement between the activation device and the spindle nut. Pivotable accommodation of the activation device can also cause transmission between the movement of the spindle nut and activation of the sensor. The possibility therefore exists of very precisely recording and starting up the position and in particular the neutral position of the spindle nut on the spindle. By pivotable accommodation, there is also the possibility of recording several positions of the spindle nut using a sensor device. A contour on the activation device can, for example, interact with a sensor device in such a way that, for example, two or more positions of the spindle nut can be recorded. For example, it is conceivable that the activation device is formed as a washer, whereby the switching device, for example, interacts with a contour and/or recess and/or elevation on the activation device. In one execution form, the activation device can naturally also be formed as a lever, whereby one end of the lever can be engaged with the spindle nut and a further end of the lever can be engaged with the sensor device.

An advantageous design form of the invention results if the activation device demonstrates at least one activation arm, whereby the activation arm can be engaged with the switching device. The activation device can be pivotably accommodated in the latch housing and/or the latch case and/or the latch lid of the motor vehicle latch. The activation device demonstrates at least one activation arm which is aligned in the direction of the switching device starting from a pivoting axis of the activation device. This activation arm engages with the switching device and activates the switching device on attainment of the neutral position, for example. It is naturally also conceivable that the activation arm disengages with the activation arm if the spindle nut has attained its neutral position; this is a preferred execution form of the invention. In the neutral position the locking mechanism is in the main ratchet position. The advantage of this is that the switching device is only activated if the spindle nut is in a position outside of the neutral position.

If the activation device demonstrates at least one drive arm, whereby the drive arm can be engaged with the spindle nut, a further design variant of the invention results. The activation device can have a two-armed design, whereby a first activation arm interacts with the switching device and a second drive arm can be engaged with the spindle nut. The drive arm interacts with the spindle nut in such a way that the activation device is pivotable. To this end, the activation arm demonstrates a bearing axis at a distance from the spindle nut. Consequently, a pivoting movement of the drive arm and a pivoting movement of the activation arm can be attained. The bearing axis of the activation device is preferably equidistant from a central axis of the spindle as the switching knob of a switching device from the central axis of the spindle. The bearing axis of the activation device and the switching knob of the switching device can thus be arranged on a plane in the motor vehicle latch parallel to the spindle axis. To activate the switching device, the activation arm is then pivoted on a circuit using the drive arm to enable activation of the switching device.

Advantageously the drive arm can be engaged with the spindle nut in a form-fitting manner. Due to a form-fitting connection between the activation device and the spindle nut and preferably on the drive arm, safe activation of the switching device and movement of the activation device is attainable. Furthermore, a suitable mesh between the activation device and the spindle nut and in particular a cooperating form on the spindle nut and/or activation device enables control of the engagement and movement of the activation device. The drive arm is preferably U-shaped and the spindle nut demonstrates a surface which can be described as cylindrical or circular, at least in places. The spindle nut can then engage into the U-shaped aperture of the drive arm and can initiate movement of the activation device by the linear movement along the spindle.

In fact, the activation device can be engaged with a housing of the motor vehicle latch. Consequently, a position of the activation device can be fixed in the motor vehicle latch. The activation device is transferred into its functional positions using the controlled movement of the spindle nut. The activation device and thus the switching device is activated by the engagement of the spindle nut into the drive arm. The activation lever or the activation device disengages from the spindle nut in at least one functional position of the spindle nut. When the locking mechanism closes, the spindle nut preferably disengages from the activation lever. In order to also secure or stabilize the position of the activation lever in this position, the invention provides for the position of the activation device in the motor vehicle latch and in particular in interplay with the latch housing and/or the latch lid being ascertainable. Form-fitting engagement is preferably selected, whereby a form-fitting positional securing of the activation lever is also conceivable. The activation lever is only fixed in the extreme position of the activation device, in other words the activation device can be freely pivotable outside of the fixing position. i.e. the activation device is at least fixed in the end position in which the activation device disengages from the spindle nut. For example, fixing can occur via an interplay of the drive arm and also the activation arm with the housing or the housing lid. It is hereby conceivable, for example, that after movement of the activation device into a release position in which the spindle nut leaves the activation lever, the activation lever can be fixed by means of the housing. If the spindle nut disengages from the activation device during closure of the locking mechanism, the activation device can be arranged in the motor vehicle latch in such a way that the spindle nut remains engaged with the activation device during unlocking.

In a further design variant of the invention, the activation device can be engaged with the housing in a form-fitting manner. The form fit between the activation device and at least one component of the housing of the motor vehicle latch hereby enables secure fixing of the activation device into its position detached by the spindle nut. The activation lever is preferably moved so far by means of the spindle nut that a complete form fit occurs between the activation lever and the housing. The form fit can also be present as a combined force fit and form fit. For example, if the drive arm engages into the housing in a form-fitting manner and a further part of the activation device forms a force-fitting connection with the housing. The form fit and the force fit can also be executed at the bearing point of the activation device.

The drive arm preferably demonstrates an extension, whereby the extension can be engaged with the housing. An extension on the drive arm uncouples the functions of the drive from the fixing function of the activation device. If, for example, a U-shaped mounting cooperatively engages between the activation device and the spindle nut, the extension fixes the activation device in an engagement position. The end position of the activation device is hereby described as an engagement position in which the activation device can be detached from the spindle nut. The task of the extension is to fix the activation lever in the end position. This is especially advantageous if the extension can be engaged on an elevation, recess or a further component of the motor vehicle latch. Hereby, a position-securing spring for the activation device can be dispensed with. Consequently, a cost-effective solution can be achieved. Furthermore, the use of an extension on the activation device offers the advantage that the position securing of the activation device can be executed at a distance from the pivoting area and thus in a structurally favorable position in the motor vehicle latch.

If the extension is formed as a spring arm and can be engaged with a recess in the housing, a further design variant of the invention is attained. A sprung extension hereby enables the activation arm or the extension integrally connectable to the activation arm to be inserted into a recess of the latch. The spring arm can be elastically deformed in such a way and engaged with the housing in the manner of a clip connection. A recess or aperture present in the housing can preferably also fulfill a position securing function, which offers a structural advantage in turn. In particular by means of a spring arm an additional spring for stabilizing the position of the activation device can be eliminated.

If the switching device can be activated by means of the activation device in an opening position of the locking mechanism and in a closure position of the spindle drive, a preferred design variant of the invention results. In a neutral position or central position, which can also be described as a home position, the switching device is inactivated. This is advantageous because the motor vehicle latch is mostly in a closed position in relation to the lifespan. The switching device is thus exposed to the least possible stress. In one end position of the spindle nut on the spindle of the so-called opening position, the spindle nut activates a triggering lever, meaning that the locking mechanism can be unlocked. In an end position opposite the opening position, i.e. an end position of the spindle nut on the spindle the spindle nut is in a closure position. In both end positions of the spindle nut, i.e. in the opening position and the closure position the activation device interacts with the switching device in such a way that a sensor signal or a switching signal can be detected. The construction according to the invention provides a structurally favorable and reliable activation device in order to safely record the functional positions, opening position, closure position and neutral position.

The invention is described in further detail below with reference to the attached sketches on the basis of a preferred execution example. However, the principle applies that the execution example does not limit the invention, but only constitutes an execution form. The characteristics depicted can be executed individually or in combination, individually or in combination with other characteristics of the description, as also the patent claims.

Figure 2:
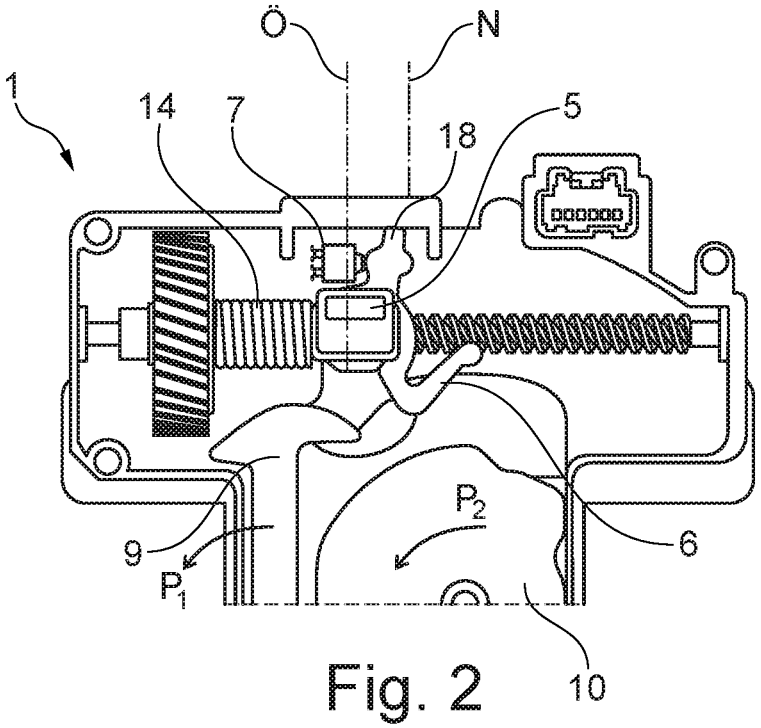
Figure 3:
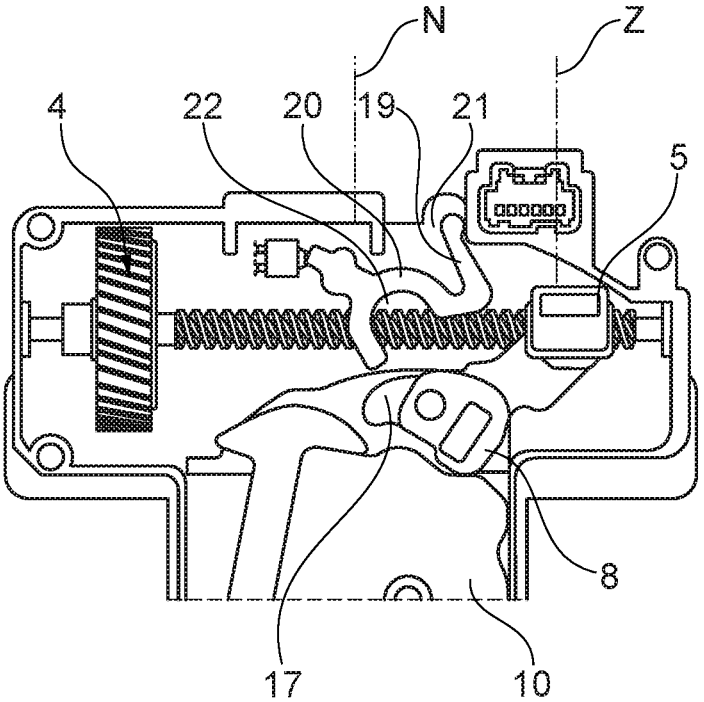

The following are shown:

FIG. 1 a top view of a flap latch with a spindle drive, an activation device and a partially illustrated locking mechanism in a neutral position, FIG. 2 the execution example according to FIG. 1, whereby the spindle nut is in an opening position, and FIG. 3 the flap latch according to FIG. 1, whereby the spindle nut is illustrated driven into a closure position.

A motor vehicle latch 1 in a top view on a housing 2, a latch case 3 in an open illustration is reproduced in FIG. 1. Inside the motor vehicle latch 1 and in particular also inside the housing 2 of the motor vehicle latch 1 a spindle drive 4, a spindle nut 5, an activation device 6, a switching device 7, a closure device 8, a triggering lever 9 and a catch 10 as part of a locking mechanism 11 are reproduced. The spindle nut 5 can be driven along a spindle 12 and backwards and forwards in the direction of the arrow P. The latch housing 2 also demonstrates a plug 13 for the electrical contact of the motor vehicle latch 1. A spiral spring 14 is also arranged around the spindle 12 to assist at least part of the actuator movements of the spindle nut 5.

The spindle nut 5 is located in a neutral position N in the functional position shown in FIG. 1. In this state, the locking mechanism 11 is in the locked state, i.e. the motor vehicle latch 1 is closed. The activation lever 6 is disengaged from the switching device 7, or the activation device 6 is only adjacent on the switching device 7. In this execution example, the activation device 6 can be pivoted around a pivot axis 15. An activation arm 16 of the activation device 6 is adjacent on the switching device 7 without the switching device 7 being activated. The activation device 6 can be pivoted free out of this position using the spindle nut 5. A closure device 8 and a triggering device 17 are connected to the spindle nut 5. The triggering device 17 interacts with the triggering lever 9, whereby the closure device 8 can be engaged with the catch 10.

In FIG. 2 the motor vehicle latch 1 is reproduced in an opening position O according to FIG. 1. The spindle nut 5 was driven left from the neutral position N into the opening position O in FIG. 2. The spiral spring 14 was compressed in the process, whereby a force can be generated in the direction of the spindle nut 5. By the spindle nut 5 being driven into the opening position O the triggering lever 9 was pivoted in the direction of the arrow P1. Consequently, the catch 10 can be pivoted in the direction of the arrow P2 and the motor vehicle latch can be opened. The activation device 6 was pivoted around the pivot axis 15. Consequently, the wave contour 18 on the activation arm 16 interacts with the switching device 7 and activates the switching device 7. In this opening position. the spindle nut 5 remains engaged with the activation device 6 and thus stabilizes the position of the activation device 6.

The spindle nut 5 is reproduced in the closure position Z in FIG. 3. The spindle nut 5 is driven by means of the spindle drive 4 and preferably an electrical drive. As clearly apparent in FIG. 3, the spindle nut 5 is disengaged from the activation device 6. An extension 19 formed as a spring element is integrally molded to a U-shaped drive arm 20. Hereby the extension 19 acts in a form-fitting manner with a recess 21 in the housing 2. The position of the activation device 6 is thus fixed by means of the extension 19. The U-shaped aperture 22 on the drive arm 20 thus remains in a release position. Consequently, the spindle nut 5 can engage with the activation device 6 during a resetting movement. As already apparent, the wave contour 18 is in turn adjacent to the switching device 7 and activates the switching device 7. Consequently, a position of the activation device 6 is detectable. In the closure position Z, the catch 10 was transferred into a locking position by means of the closure device 8. Consequently, the pawl can be engaged with the catch 10. The spindle nut 5 is driven back from this closure position Z. Consequently, the spindle nut 5 goes into the neutral position N. Safe recording of the positions of the spindle nut 5 is therefore possible by means of the activation device 6 and with the least possible constructional means.

REFERENCE SIGN LIST

1 Motor vehicle latch
2 Housing
3 Latch case
4 Spindle drive
5 Spindle nut
6 Activation device
7 Switching device
8 Closure device
9 Triggering lever
10 Catch
11 Locking mechanism
12 Spindle
13 Plug
14 Spiral spring
15 Pivot axis
16 Activation arm
17 Triggering device
18 Grooved contour
19 Extension
20 Drive arm
21 Recess
22 Aperture
P, P1, P2 Arrow
N Neutral position
Z Closure position
O Opening position

The invention claimed is:

1. A motor vehicle latch that is electrically actuated, the motor vehicle latch comprising:

a locking mechanism;

a triggering lever for unlocking the locking mechanism;

a closure device for moving the locking mechanism from a pre-ratchet position into a main ratchet position, wherein the closure device includes a spindle drive having a spindle nut movable between an opening position in which the spindle pivots the triggering lever to unlock the locking mechanism, a closure position in which the closure device moves the locking mechanism toward the main ratchet position, and a neutral position between the opening position and the closure position;

at least one sensor for detecting a position of the spindle nut; and an activation device that is engageable between the spindle nut and the at least one sensor and is engageable by the spindle nut to activate the at least one sensor, wherein when in the closure position, the spindle nut is disengaged from the activation device, and wherein when in the neutral position, the spindle nut is engaged with the activation device which activates the at least one sensor, wherein the activation device is a rotatably mounted component.

2. The motor vehicle latch according to claim 1, wherein the activation device can be detachably engaged with the spindle nut.

3. The motor vehicle latch according to claim 1, wherein the activation device can be pivotably accommodated in the housing.

4. The motor vehicle latch according to claim 1, wherein the activation device includes at least one activation arm.

5. The motor vehicle latch according to claim 1, wherein the activation device includes at least one drive arm, wherein the drive arm can be engaged with the spindle nut.

6. The motor vehicle latch according to claim 5, wherein the drive arm includes an aperture which receives the spindle nut.

7. The motor vehicle latch according to claim 1, wherein the activation device can be engaged with a housing of the motor vehicle latch whereby a position of the activation device can be fixed in the motor vehicle latch.

8. The motor vehicle latch according to claim 7, wherein the drive arm demonstrates an extension, whereby the extension can be engaged with the housing.

9. The motor vehicle latch according to claim 8, wherein the extension is formed as a spring arm and can be engaged with a recess in the housing.

10. The motor vehicle latch according to claim 1, wherein the sensor can be actuated using the activation device in an opening position of the locking position and in the closure position of the spindle nut.

11. The motor vehicle latch according to claim 1, wherein the activation device is rotatable about an axis.

12. The motor vehicle latch according to claim 1, wherein the activation device has a contour that engages the sensor when the spindle nut is in the opening position and when the spindle nut is in the neutral position.

13. The motor vehicle latch according to claim 12, wherein the activation device has an activation arm on which the contour is formed, and wherein an end of the activation arm engages the sensor when the spindle nut is in the closure position.

14. The motor vehicle latch according to claim 1, wherein the activation device has an activation arm that is engageable with the sensor and an extension that is connected to the activation arm and engages a housing.

15. The motor vehicle latch according to claim 1, wherein the spindle nut moves is linearly movable in a first direction toward the closure position and in a second direction opposite the first direction toward the neutral position.

16. The motor vehicle latch according to claim 1, wherein the spindle nut indirectly engages the sensor through the activation device which directly engages the sensor.

17. The motor vehicle latch according to claim 1, wherein the at least one sensor is a microswitch.

18. A motor vehicle latch comprising:

a locking mechanism;

a closure device including a spindle drive having a spindle nut movable between an opening position in which the locking mechanism is unlocked, a closure position in which the closure device moves the locking mechanism toward the main ratchet position, and a neutral position between the opening position and the closure position;

at least one sensor for detecting the neutral position of the spindle nut; and an activation device that is engageable between the spindle nut and the at least one sensor and is engageable by the spindle nut to activate the at least one sensor when the spindle nut is in the neutral position, wherein the activation device is a rotatably mounted component.

19. A motor vehicle latch that is electrically actuated, the motor vehicle latch comprising:

a locking mechanism;

a triggering lever for unlocking the locking mechanism;

a closure device for moving the locking mechanism from a pre-ratchet position into a main ratchet position, wherein the closure device includes a spindle drive having a spindle nut movable between an opening position in which the spindle pivots the triggering lever to unlock the locking mechanism, a closure position in which the closure device moves the locking mechanism toward the main ratchet position, and a neutral position between the opening position and the closure position;

at least one sensor for detecting a position of the spindle nut; and an activation device that is engageable between the spindle nut and the at least one sensor and is engageable by the spindle nut to activate the at least one sensor, wherein when in the closure position, the spindle nut is disengaged from the activation device, and wherein when in the neutral position, the spindle nut is engaged with the activation device which activates the at least one sensor, wherein the activation device is a rotatably mounted component having an activation arm that is engageable with the sensor and an extension that is connected to the activation arm and engages a housing.

* * * * *